US005246076A

United States Patent [19]

Watson

[11] Patent Number: 5,246,076

[45] Date of Patent: Sep. 21, 1993

[54] METHODS AND APPARATUS FOR CONTROLLING LONG-STROKE PUMPING UNITS USING A VARIABLE-SPEED DRIVE

[75] Inventor: Jerry L. Watson, Odessa, Tex.

[73] Assignee: Evi-Highland Pump Company, Odessa, Tex.

[21] Appl. No.: 849,162

[22] Filed: Mar. 10, 1992

[51] Int. Cl.[5] ..... E21B 43/12

[52] U.S. Cl. ..... 166/369; 166/68.5; 166/105; 417/18

[58] Field of Search ..... 166/369, 373, 105, 107, 166/101, 68, 68.5; 417/18, 45

[56] References Cited

U.S. PATENT DOCUMENTS

| | | | |
|---|---|---|---|
| 4,102,394 | 7/1979 | Botts | 166/65 R |
| 4,145,161 | 3/1979 | Skinner | 417/22 |
| 4,390,321 | 6/1983 | Langlois et al. | 417/15 |
| 4,487,061 | 12/1984 | McTamaney et al. | 73/151 |
| 4,490,094 | 12/1984 | Gibbs | 417/42 |
| 4,661,751 | 4/1987 | Werner | 318/332 |
| 4,916,959 | 4/1990 | Lively | 74/37 |
| 4,935,685 | 6/1990 | Justus et al. | 318/798 |
| 4,971,522 | 11/1990 | Butlin | 417/18 |
| 4,973,226 | 11/1990 | McKee | 417/18 |
| 5,006,044 | 4/1991 | Walker, Sr. et al. | 417/12 |
| 5,044,888 | 9/1991 | Hester, II | 417/45 X |

*Primary Examiner*—Terry Lee Melius

*Attorney, Agent, or Firm*—Steven G. Lisa; Peter C. Warner

[57] ABSTRACT

A variable-speed drive controller and associated methods are disclosed for reciprocated lifting systems, particularly long-stroke, fluid-pumping systems such as certain oil-producing equipment. A variable-speed drive is controlled through an electronic feedback loop by a programmable controller, which varies the speed of the drive when sensors detect the passage of the reciprocating mechanism. The controller can be set to slow the drive when the reciprocating mechanism reaches the end of the stroke, to permit faster production of fluid without increased mechanical wear on the reciprocating mechanism or increased stress on the lifting string. The controller also can be set to slow the drive on the downstroke, such as to permit faster production of fluid when pumping viscous liquid.

19 Claims, 3 Drawing Sheets

METHODS AND APPARATUS FOR CONTROLLING LONG-STROKE PUMPING UNITS USING A VARIABLE-SPEED DRIVE

BACKGROUND OF THE INVENTION

This invention is in the field of drive and drive controllers for sucker-rod-pumped oil wells, particularly long-stroke pumping units.

Long-stroke pumping units are designed to lift great loads efficiently. Such units often employ belt-and-pulley systems, which include a flat belt that is coupled at one end to a counterweight assembly, that passes over a roller pulley near the top of the derrick, and that is coupled at the other end to the polished rod and rod string. A motor reciprocates the counterweight, and therefore the rod string, which drives the downhole pump. Examples of such pumping units are disclosed in my co-pending application Ser. No. 07/725,200, filed Jul. 3, 1991, and in U.S. Pat. No. 4,916,959, issued to Lively and assigned to a common assignee, both of which are incorporated herein by reference.

Mechanical, long-stroke pumping units often have a mechanical reversing mechanism that may suffer damage if the speed of the reversal at each end of the stroke is too rapid. That mechanical limitation constrains the operating speed of the pump to approximately 4 or 4.5 strokes per minute ("SPM"), which often limits the unit's ability to produce high volumes of fluid. If the pumping speed could be raised, greater production rates could be achieved.

It is therefore an object of the invention to increase pump production by varying pumping speed.

It is another object of the invention to avoid damage to the pumping equipment by controlling the speed of the pump motor depending on factors such as pump position, load, and type of fluid being pumped.

It is another object of the invention to increase pump speed in portions of the stroke that will permit safe increase in production.

It is another object of the invention to reduce pump speed in the portions of the stroke that are susceptible to equipment damage.

It is another object of the invention to improve production of viscous fluids by increasing pumping speed on the upstroke.

It is another object of the invention to provide a means for allowing the operator to control the pumping speed within differing parts of a stroke.

It is another object of the invention to provide a pump that works at a different speed on the upstroke than on the downstroke.

The above and other objects are achieved by an apparatus and method for controlling a pump lifting system. A lifting string is vertically reciprocated through a pumping stroke. A variable-speed drive is controlled through an electronic feedback loop from the shaft of the motor, back to a drive-control system. Position sensors detect the passage of some portion of the apparatus past a fixed position in the pumping stroke and send signals to the drive controller. The signals from the position sensors are used to vary the motor speed, thus controlling the pumping speed. The controller may operate to slow down at both ends of the long stroke, to have different speeds on the upstroke or downstroke, or to permit manual or automated variations in the pumping speed over time. By utilizing such a drive in a long-stroke pumping unit, the average pumping speed of the unit can be safely increased without equipment damage.

Other aspects of the invention will be appreciated by those skilled in the art after a reading of the detailed disclosure of the present invention below.

DETAILED DESCRIPTION

Figure 1:
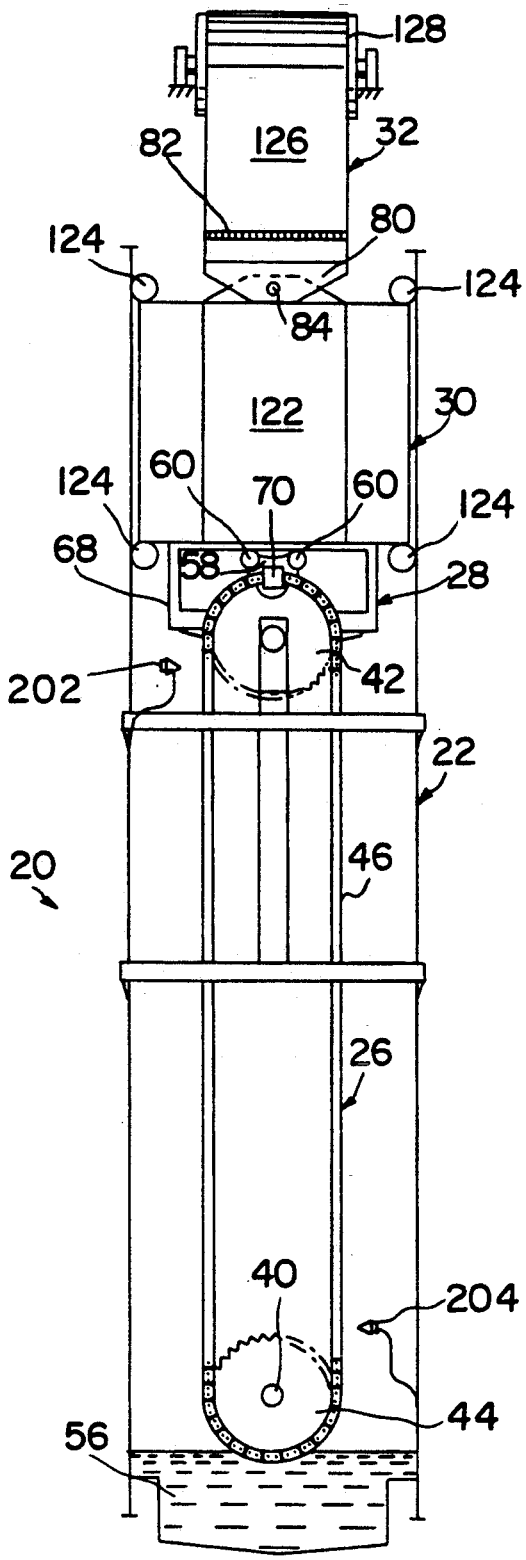
FIG. 1 depicts in simplified schematic form a rear view of one embodiment of a typical belt-and-pulley apparatus, with the counterweight assembly shown in the up position.

A long-stroke belt-and-pulley lifting system of the type disclosed in U.S. Pat. No. 4,916,959 is shown generally in FIG. 1 of the present specification. For clarity and convenience, where possible, the same numerals for the same elements of the figures of the '959 Patent have been used in the present specification. FIG. 1 depicts a lifting unit 20 that includes derrick structure 22, chain-and-sprocket assembly 26, carriage assembly 28, counterweight assembly 30, and belt-and-pulley assembly 32. Lifting unit 20 is designed to operate a polished rod assembly (not shown), which is in turn connected by a rod string extending down a well to the downhole pump (also not shown).

In the illustrative system shown in FIG. 1, belt-and-pulley assembly 32 includes belt 126 and pulley 128. Belt 126 engages pulley 128, which is an idler pulley attached at or near the top of derrick structure 22. Derrick structure 22 includes many upright members and frame support members to provide a stable framework to support the various other elements of lifting unit 20.

Belt 126 is coupled, in one of several ways, to the top of counterweight assembly 30. The other end of belt 126 (not shown), on the far side of the derrick assembly from the viewpoint of FIG. 1, is coupled to the polished rod assembly. Counterweight assembly 30 includes counterweight 122, which can be of any shape, and various wheels 124, which engage derrick structure 22 to guide counterweight 122 within derrick structure 22 as lifting unit 20 operates.

Figure 2:
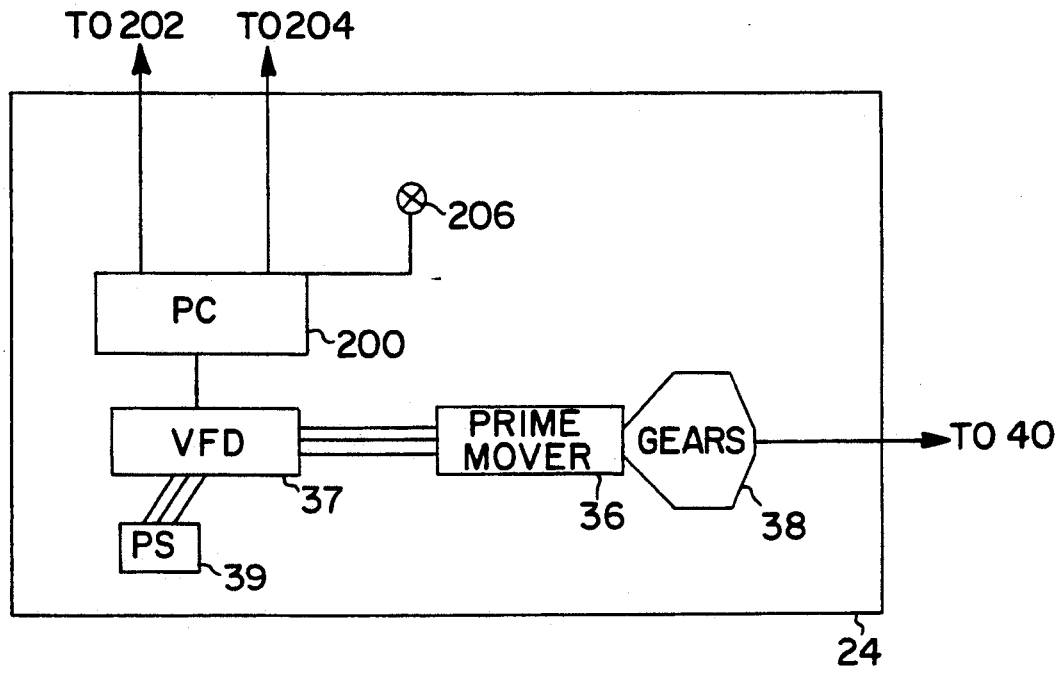
FIG. 2 depicts a block diagram of the motor assembly of the invention.

The block diagram of FIG. 2 shows drive assembly 24, which drives lifting unit 20. Drive assembly 24 includes prime mover 36 and gearbox 38, which operate to rotate output shaft 40 in FIG. 1. Thus, the output from drive assembly 24 is the rotation of output shaft 40 at an appropriate speed.

Returning to FIG. 1, chain-and-sprocket assembly 26 includes upper sprocket 42 and lower sprocket 44, which are vertically arranged in a common plane, and endless chain 46. Lower sprocket 44 is coupled to output shaft 40 and thus is rotationally driven as shaft 40 rotates. Upper sprocket 42 is an idler sprocket. Other suitable forms of driven systems can be substituted for chain-and-sprocket assembly 26.

Endless chain 46 is engaged and driven by lower sprocket 44. Upper sprocket 22, the idler sprocket, is driven by chain 46. Thus, as prime mover 36 operates, endless chain 46 is driven in an orbital loop around sprockets 42 and 44. Block base 58 is mounted on rolling devices, such as wheels 60, in carriage assembly 28, and is attached to endless chain 46 by swivel knuckle 70. Thus, block base 58 travels in an orbital loop around sprockets 42 and 44 with endless chain 46.

Wheels or rollers 60 can be rotatably attached to the eight corners of block base 58 and engage rails (not shown) in frame 68. As block base 58 moves in the orbital loop around sprockets 42 and 44, block base 58 and wheels 60 move horizontally with respect to and within frame 68. Other means for supporting block base 58 and engaging frame 68 can be substituted for wheels 60 and the rails.

When block base 58 rounds one of the sprockets, 42 or 44, a horizontal movement of block base 58 relative to frame 68 will occur. For example, as block base 58 rounds upper sprocket 42, it may move from the left side of frame 68 to the right side. When knuckle 70 is travelling downward, the lower wheels push frame 68 downward. When knuckle 70 is travelling upward, by contrast, the upper wheels push frame 68 upward.

Because counterweight assembly 30 is coupled to frame 68, counterweight assembly 30 reciprocates with frame 68 and in turn drives belt-and-pulley system 32. As belt-and-pulley system 32 reciprocates, it in turn reciprocates the polished rod assembly coupled to the other end of belt 126.

If the motor is driven at a fast enough rate, block base 58 and swivel knuckle 70 will move extremely quickly within frame 68 as they round sprockets 42 and 44. The reversing mechanism that includes block base 58 is heavy, weighing more than one ton in some systems. The stresses on the system, particularly chain 46, therefore, are extremely great, and too fast of a reversal of block base 58 within frame 68 can cause mechanical breakdown in the reversing mechanism. For example, chain 46 can stretch, causing it to wear more quickly and causing further mechanical problems, even including possible damage to frame 68 itself. Although only one specific form of reversing mechanism is discussed above, other reversing mechanisms, including that of U.S. Pat. No. 4,651,582 issued to Bender, which discloses a rod-and-wrist-pin reversing assembly, can also suffer damage from excessive pumping speed at the reversal points.

Besides causing mechanical problems, the very rapid acceleration and deceleration of the polished rod and rod string at the ends of the stroke frequently causes, in certain well conditions, undesirable load changes, reflected on the dynamometer card. The rapid reversal at the beginning of the upstroke causes an increased load, and the rapid reversal at the beginning of the downstroke causes a decreased load, as illustrated in the sample dynamometer card in FIG. 3, which is taken from an actual well. The spike at the upper left of FIG. 3 occurs as knuckle 70 rounds the upper right quadrant of sprocket 42 in FIG. 1, and the spike at the lower right of FIG. 3 occurs as knuckle 70 rounds the lower left quadrant of sprocket 44 in FIG. 1. Such extreme loading and unloading increases the stress on the sucker rod string.

Figure 3:
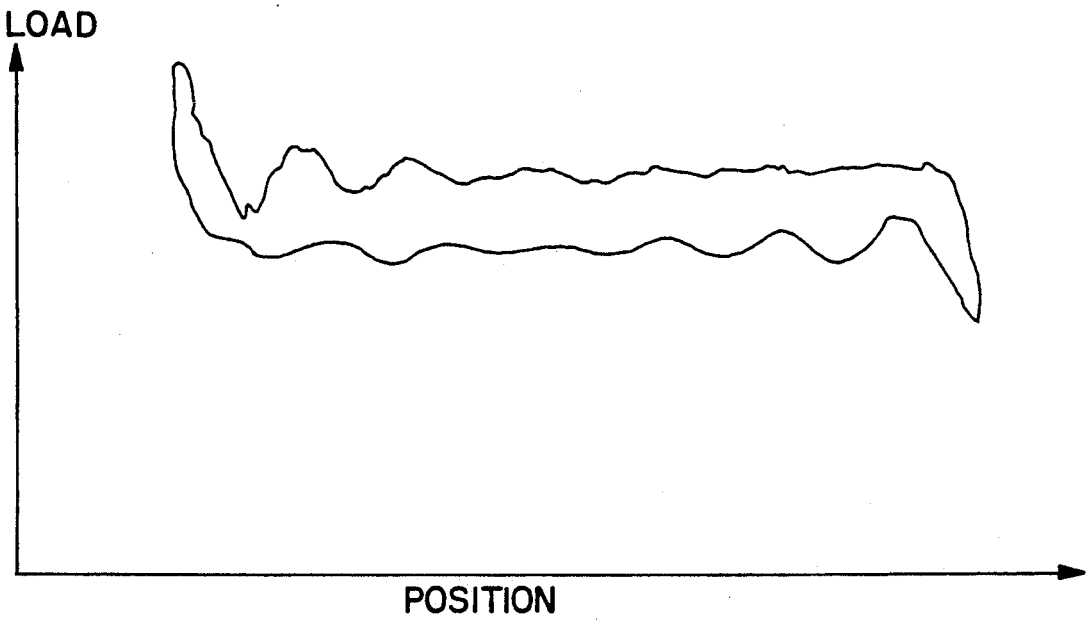
FIG. 3 shows an example dynagraph from a pump not using the system of the invention.

Moreover, such load spikes will often reach the highest or lowest load values during the stroke, as illustrated in FIG. 3. The measured range, that is the difference between the highest and lowest loads, is typically used to select a grade of sucker rod. Slowing the reversals greatly reduces load spiking, often causing a corresponding reduction in measured range and permitting use of less expensive, lighter grades of sucker rods.

In accordance with the objects of this invention, however, the drive controller slows the speed of the drive as the reversing mechanism operates. In FIG. 2, a variable-speed drive 37 is coupled to a power source 39, which in one form alters the speed of prime mover 36 by varying the frequency from power source 39. Programmable controller 200 supervises the frequency of power source 39 based on the system described below.

As the unit operates, chain 46 and block base 58 move clockwise from the perspective of FIG. 1. Position sensors are needed to identify the place in the stroke at which controller 200 will slow the speed of prime mover 36. For example, in the configuration illustrated in FIG. 1, near the turnaround (end of stroke) position, position sensor 202 senses the presence of block base 58. Sensor 202 can be a proximity sensor of any sort, including the type using photoelectric, magnetic, or mechanical principles. Sensor 202 is preferably placed at or somewhat below the "nine o'clock" position of sprocket 42, adjacent to chain 46.

Sensor 202 sends a signal to controller 200 indicating the passage of block base 58, the receipt of which causes controller 200 to reduce the frequency of variable-frequency drive 37, thus reducing the speed of motor 36 from the normal rate. For example, the system may pump ordinarily at 6 SPM, but have a need to slow the reversal speed of the mechanical mechanism to a safe rate, such as approximately 4 to 4.5 SPM. Controller 200 gradually reduces the speed of drive 37 over a fixed time period. The operator can adjust the deceleration rate and the time period to the specific characteristics of the lifting unit, such as the pumping speed. Controller 200 preferably should be programmed, however, to complete the speed reduction, taking inertia into account, no later than the point at which knuckle 70 has carried to a position about halfway between the top of sprocket 42 and the point at which the portion of chain 46 adjacent to knuckle 70 engages sprocket 42.

After a second user-set fixed time period, which in the preferred embodiment is set to carry knuckle 70 to approximately the point at which knuckle 70 rounds and disengages from sprocket 42, controller 200 gradually speeds up to the higher, original rate, and block base 58 continues to move down the path of chain 46. At the opposite end of the stroke, a second position sensor 204 similarly senses the presence of block base 58, and again causes a slowing in the speed of the reversing mechanism.

If the desired speed variations are relatively simple and drive 37 is sufficiently versatile, controller 200 can be omitted entirely, and position sensors 202 and 204 can be hard-wired directly into drive 37. In more complex embodiments, some form of programmable controller, either custom-designed or commercially available, can be included as controller 200. Suitable types of drive 37 are sold commercially by several vendors as "vector drive" motors. It has been found that the Series 14 Flex Vector Drive motor sold by Baldor Co. of Ft. Smith, Ark., coupled with the programmable controller sold by IDEC Corp. as Model SC1A-C2AE, are suitable for drive 37 and controller 200, respectively.

During the majority of the stroke, the unit runs at the higher rate-in the example, 6 SPM. Therefore, pumping speed averaged over the entire stroke, is close to the faster speed, particularly in a long-stroke system. Using the sample numbers quoted above, for example, the average rate could reach approximately 5.5 SPM. That effect ultimately results in the unit being able to produce greater volumes of fluid without equipment damage.

In another embodiment of the invention, controller 200 includes a programmable electronic device that can be programmed to cause faster movement on the upstroke than on the downstroke. For example, the controller can be programmed to pump at a rate of 4 SPM on the upstroke but only 2 SPM on the downstroke. Such a feature is useful particularly when pumping heavy crude oil, where the fall of the rod string through a viscous fluid, or rate of filling of the downhole pump, limits the maximum pumping rates and, consequently, total fluid production.

Figure 4:
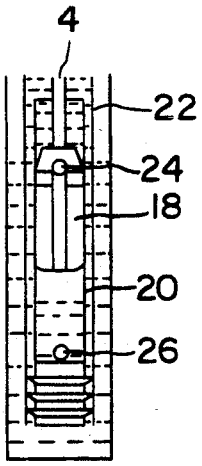
FIG. 4 shows a close-up, cross-sectional view of the downhole pump, shown during the upstroke.

Referring to FIG. 4, which illustrates in cross-section the downhole pump, rod string 4 connects the pumping unit to plunger 18 of the pump, which is moved up and down in barrel 20 by the reciprocating motion of rod string 4. On the upstroke, the fluid (shaded) within tubing 22 is raised by the pump, and all of the fluid load is supported by plunger 18 and travelling valve 24. On the downstroke, plunger 18 moves downward into pump barrel 20 filled with liquid. The pressure of the fluid in barrel 20 causes the ball of travelling valve 24 to open and allow plunger 18 to travel downward through the liquid in pump barrel 20. On the downstroke, therefore, the fluid load is transferred from plunger 18 and travelling valve 24 to standing valve 26 and tubing 22.

On the downstroke in conditions of highly viscous fluid, the fluid passes only very slowly through the gap through the center hole of plunger 18 on the downstroke and the fluid more greatly resists the downward movement of plunger 18. Those effects combine to restrict the speed at which plunger 18 can travel downward. In conditions of viscous fluid, that constraint may become significant enough to restrict the overall pumping rate of the system.

Nevertheless, even if the maximum fall rate is limited to 2 SPM, for example, a faster rate, such as 4 SPM, can be used on the upstroke because the fluid viscosity does not restrict the speed of the upstroke. By using the variable-speed drive to permit faster pumping on the upstroke, therefore, using the above example speeds, an average pumping speed of 3 SPM could be achieved, yielding a 50% increase in production. Use of a single-speed motor in that case would result in a situation where the maximum downstroke velocity would limit the pumping speed on both the downstroke and the upstroke to 2 SPM.

A further embodiment includes a manual control 206, shown in FIG. 2, such as a simple knob or an electronic input, permitting user adjustment of the pumping speed. Manual control over the normal pumping speed is an extremely convenient feature for operations in all types of oil well pumping. Manual control 206 also can be used in conjunction with a pump-off controller to allow the unit to slow the pumping speed upon recognition of pump-off rather than stop and restart, as is the normal practice.

Further, the invention permits greatly improved overall operating efficiencies. Normally, long-stroke units require motors with relatively high starting torque, such as those graded in the NEMA D class. Because a variable-speed motor permits operation without the need for high starting torque, it is possible to utilize a lower-torque motor for motor 36, such as a NEMA B super high efficient motor. Such motors can achieve efficiencies of about 94–95%, an efficiency improvement over the usual motor of about 13 percent.

It is understood by those skilled in the art that numerous alternate forms and embodiments of the invention can be devised without departing from its spirit and scope. Features of the invention deemed novel are set forth below in the claims.

I claim:

1. An apparatus for controlling a pump lifting system comprising:

(a) a lifting string;

(b) means for vertically reciprocating the string through a pump stroke;

(c) a variable-speed motor driving the reciprocating means;

(d) sensing means for sensing when a select portion of the apparatus passes a select position and for generating a signal; and (e) control means for receiving the signal and for using the signal to slow the speed of the motor near a bottom and near a top of each reciprocated stroke as compared to the speed of the motor at another part of the same stroke.

2. The apparatus of claim 1 wherein the sensing means includes first switch means for signalling when a select portion of the reciprocating means is approaching a top of the pump stroke and second switch means for signalling when a select portion of the reciprocating means is approaching a bottom of the pump stroke.

3. The apparatus of claim 2 wherein the control means includes means for receiving the signal from the first switch means and controlling the motor to temporarily slow it near a top of the reciprocated stroke and means for receiving the signal from the second switch means and for controlling the motor to temporarily slow it near a bottom of the reciprocated stroke.

4. The apparatus of claim 1 wherein the control means further comprises means for running the motor during at least part of a downstroke at a slower rate than during the remainder of the stroke.

5. The apparatus of claim 1 further comprising means for manually varying the base motor speed.

6. The apparatus of claim 1 further comprising means for varying the motor speed automatically over time.

7. The apparatus of claim 1 wherein the lifting string includes a rod string and a fluid pump.

8. The apparatus of claim 1 wherein the variable-speed motor comprises an electric drive motor with a variable-frequency power source.

9. The apparatus of claim 1 wherein the reciprocating means includes a long-stroke counterweighted pump.

10. The apparatus of claim 1 wherein the reciprocating means includes a pair of sprockets, an endless chain passing around the sprockets, a reversing mechanism coupled to the chain, and a counterweight coupled to the reversing mechanism.

11. The apparatus of claim 10 wherein the position sensing means includes first switch means for signalling when the reversing mechanism is approaching a top of the pump stroke and second switch means for signalling when the reversing mechanism is approaching a bottom of the pump stroke.

12. The apparatus of claim 11 wherein the control means includes means for receiving the signal from the first switch means and for using the signal to temporarily slow the reversing mechanism near the top of stroke and means for receiving the signal from the second switch means and for using the signal to temporarily slow the reversing mechanism near the bottom of stroke.

13. A method for driving a downhole pump lifting system with a variable-speed motor comprising the steps of:

(a) reciprocating the lifting system so that it completes pumping cycles comprised of an upstroke and a downstroke;

(b) detecting a select portion of the lifting system as the portion passes a first select position in the upstroke of each pumping cycle and again as the portion passes a second select position in the downstroke of each pumping cycle;

(c) generating a signal when the detection occurs; and (d) using the signal to control the motor by varying its speed each time the signal is generated.

14. The method of claim 13 wherein the motor-control step includes the step of varying the frequency of the power to the motor to slow the lifting system temporarily near each end of the reciprocated stroke.

15. The method of claim 13 wherein the reciprocation step comprises the step of driving around a pair of sprockets an endless band that has a reversing mechanism coupling the band to a counterweight of the lifting system, and wherein the detecting step comprises the step of detecting the reversing mechanism as it passes the two select positions.

16. The method of claim 14 wherein the motor-control step includes the step of slowing the motor gradually, running the motor at the slower speed for a select period of time, and then increasing the motor's speed gradually.

17. An apparatus for controlling a pump lifting system comprising:

(a) a lifting string including a rod string and a fluid pump;

(b) means for vertically reciprocating the lifting string through a pump stroke, the means including a vertical drive and a reversing mechanism coupled to the drive;

(c) a variable-speed motor driving the reciprocating means, comprising an electric drive motor with a variable-frequency power source;

(d) first switch means for sensing when the reversing mechanism is approaching a top portion of the vertical drive and for generating a first signal;

(e) second switch means for sensing when the reversing mechanism is approaching a bottom portion of the vertical drive and for generating a second signal; and (f) control means for receiving the first signal and for using it to slow the motor for a first selected portion of the stroke, and for receiving the second signal and for using it to alter the motor speed for a second selected portion of the stroke.

18. The apparatus of claim 17 wherein the control means includes means for using at least one of the signals to slow the motor gradually, during the portion of the stroke in which the reversing mechanism is reversing.

19. The apparatus of claim 18 wherein the control means includes means for gradually increasing the speed of the motor a preset period of time after the motor was slowed.

* * * * *